United States Patent [19]

Inui et al.

[11] 4,054,216

[45] Oct. 18, 1977

[54] APPARATUS FOR CONTROLLING BUCKET IN TRACTOR MOUNTED LOADER

[75] Inventors: Takayasu Inui, Osaka; Masao Kato, Hirakata, both of Japan

[73] Assignee: Kabushiki Kaisha Komatsu Seisakusho, Tokyo, Japan

[21] Appl. No.: 633,119

[22] Filed: Nov. 18, 1975

[30] Foreign Application Priority Data

| | | |
|---|---|---|
| Nov. 18, 1974 | Japan | 49-132007 |
| Nov. 18, 1974 | Japan | 49-132008 |
| Feb. 19, 1975 | Japan | 50-21833[U] |

[51] Int. Cl.[2] ..... E02F 3/32

[52] U.S. Cl. ..... 214/138 R; 214/776

[58] Field of Search ..... 214/138 R, 773, 774, 214/775, 776

[56] References Cited

U.S. PATENT DOCUMENTS

| | | | |
|---|---|---|---|
| 2,965,253 | 12/1960 | Poulter et al. | 214/138 R |
| 3,239,083 | 3/1966 | Guinot | 214/138 R |
| 3,259,259 | 7/1966 | Metailler | 214/138 R |
| 3,327,880 | 6/1967 | Brown | 214/776 |
| 3,792,786 | 2/1974 | Goikhburg et al. | 214/773 |

FOREIGN PATENT DOCUMENTS

| | | | |
|---|---|---|---|
| 1,207,279 | 12/1965 | Germany | 214/775 |

*Primary Examiner*—Robert J. Spar
*Assistant Examiner*—Ross Weaver
*Attorney, Agent, or Firm*—Armstrong, Nikaido & Marmelstein

[57] ABSTRACT

An apparatus for controlling bucket in tractor mounted loader, characterized in that a reach lever is pivoted to the body of tractor so as to be swingable in the forward and backward directions; a lift arm is pivoted to the free end of said reach lever so as to be raised and lowered; a bucket is rotatably pivoted to the forward end of said lift arm by use of a tilt cylinder; a reach cylinder is pivoted to said reach lever at the pivoting portion thereof, the contractibly extending end of said reach cylinder being pivoted to the lift arm; and a lift cylinder is pivotably connected between the lift arm and body of the tractor.

2 Claims, 13 Drawing Figures

APPARATUS FOR CONTROLLING BUCKET IN TRACTOR MOUNTED LOADER

BACKGROUND OF THE INVENTION

This invention relates to an apparatus for controlling bucket in tractor mounted loader so as to activate the bucket linearly in the forward and backward directions.

As shown in FIG. 1, in an example of the conventional apparatus of this type a first arm *c* is pivoted to the tractor body *a* by means of a cylinder *b* so that it can be raised and lowered; a second arm *d* is pivoted to the first arm by means of another cylinder *e;* a bucket *f* is pivoted to the second arm *d* by means of a cylinder *g;* and a correction cylinder *h* is pivotably connected between the first and second arms *c* and *d* so as to allow the cylinders *e* and *b* effecting simultaneously their extending and contracting operations and to thereby activate the bucket *f* linearly in a horizontal plane in the forward and backward directions.

In another example of the conventional apparatus as shown in FIG. 2, the second arm *d* is pivoted to the first arm *c* which is pivoted to the tractor body *a* so as to be raised and lowered; the bucket *f* is pivoted to the second arm *d;* the cylinder *g* is pivotably connected between the bucket *f* and first arm *c;* a link mechanism *i* is pivotably connected between the free end of the cylinder *b* which is pivoted to the tractor body *a,* second arm *d* and tractor body *a* so as to allow the cylinders *e* and *b* effecting simultaneously their extending and contracting movements and to thereby activate the bucket *f* linearly in a horizontal plane in the forward and backward directions.

In a still another example of conventional apparatus as shown in FIG. 3, the second arm *d* is pivoted, by way of the cylinder *e,* to the first arm *c* which is pivoted, by way of the cylinder *b,* to the tractor body *a* so as to be raised and lowered; and the bucket *f* is pivoted to the second arm *d* by way of the cylinder *g.*

Although the examples illustrated in FIGS. 1 and 2 are advantageous in that the bucket *f* can be moved linearly in a horizontal plane in the forward and backward directions, they are disadvantageous in that they cannot be constructed rigid enough because of a large number of pivoting points (hereinafter referred to as junctions) included therein.

The apparatuses illustrated in FIGS. 1 and 3 are disadvantageous in the the bucket *f,* in the position were it does not move forwardly (hereinafter referred to as the unreach position), cannot be tilted back.

Although the apparatus of FIG. 3 includes a small number of junctions and can be constructed rigid, it is disadvantageous in that the bucket *f* cannot be actuated linearly in a horizontal plane in the forward and backward directions.

SUMMARY OF THE INVENTION

It is therefore the primary object of this invention to provide an apparatus for controlling bucket in tractor mounted loader free from the above-mentioned short points involved in the conventional apparatuses.

Another object of this invention is to provide an apparatus for controlling bucket in tractor mounted loader which allows to directly actuate the bucket in a horizontal plane in the forward and backward directions and has a reduced number of junctions so as to increase the rigidity thereof.

Still another object of this invention is to provide an apparatus for controlling bucket in tractor mounted loader which allows in the unreach position to tilt back the bucket.

A further object of this invention is to provide an apparatus for controlling bucket in tractor mounted loader which, unlike the conventional apparatuses wherein assemblies have to be replaced for changing them from reach type to rigid type, can be changed from reach type to rigid type only by attaching a link to the reach cylinder mounting pin.

Other objects, features and advantages of the present invention will be readily apparent fromthe following description taken in conjunction with the accompanying drawings.

DETAILED DESCRIPTION OF THE INVENTION

Figure 1:
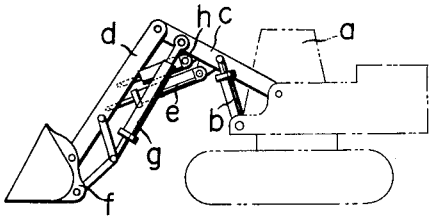
FIG. 1 PRIOR ART
FIGS. 1 to 3 are schematic front elevations of conventional apparatuses.
Figure 2:
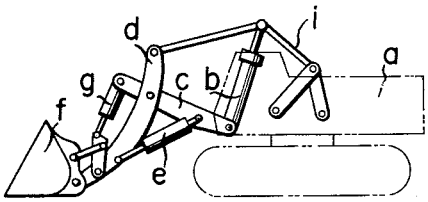
FIG. 2 PRIOR ART
Figure 3:
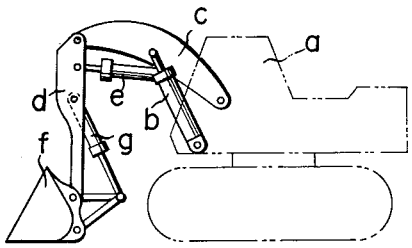
FIG. 3 PRIOR ART
Figure 4:
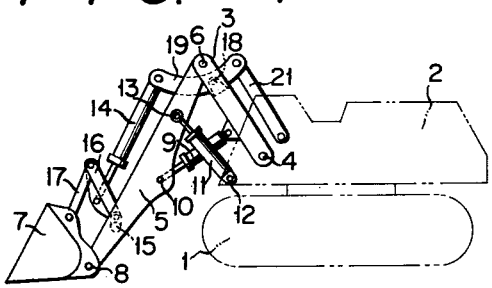
FIG. 4 is a schematic front elevation of the apparatus according to one embodiment of this invention.
Figure 5:
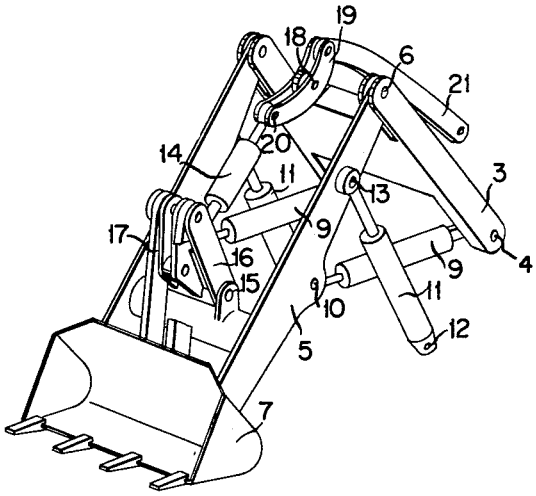
FIG. 5 is a perspective view of the main portion of the apparatus according to this invention.
Figure 6:
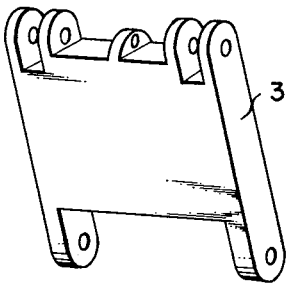
FIG. 6 is a perspective view of the reach lever.

Referring now to FIGS. 4–7, a tractor body 2 is swivelably mounted on a lower driving body 1 and a reach lever 3 is pivoted to the tractor body 2 by use of a pin 4 so that it can be raised and lowered. A lift arm 5 is pivotably connected to the free end of the reach lever 3 so that it can be raised and lowered. A bucket 7 is pivoted to the free end of the lift arm 5 by use of a pin 8.

Indicated at 9 is a reach cylinder whose base end portion is pivoted to the tractor body 2 by use of said pin 4. The contractible end of the reach cylinder 9 is pivotably connected to the intermediate position of the lift arm 5 by use of a pin 10.

Indicated at 11 is a lift cylinder which is pivoted to the tractor body 2 at pin 12. The contractibly extending end of the lift cylinder 11 is pivotably connected to the lift arm 5 by use of a pin 13 at a position closer to the pin 6. Thus the lift cylinder 11 and reach lever 3 are cooperative to support the lift arm 5 so that it can be swung in a vertical plane. The positions of pins 4, 6, 13 and 12 are so selected that, when the reach cylinder 9 is extended and contracted, the bucket 7 can be advanced and retracted horizontally in the linear directions.

Indicated at 14 is a tilt cylinder whose contractibly extending end is pivotably connected to the rear side of the bucket 7 by way of the tilt rod 17 and tilt lever 16 pivoted to the lift arm 5 at pin 15. The base end portion of the tilt cylinder 14 is pivotably connected at pin 20 to one free end of a rock link 19 which is pivotably supported by the reach lever 3 by use of a pin 18. Another free end of the rock link 19 is pivotably connected to the tractor body 2 by way of a rod 21.

Figure 7:
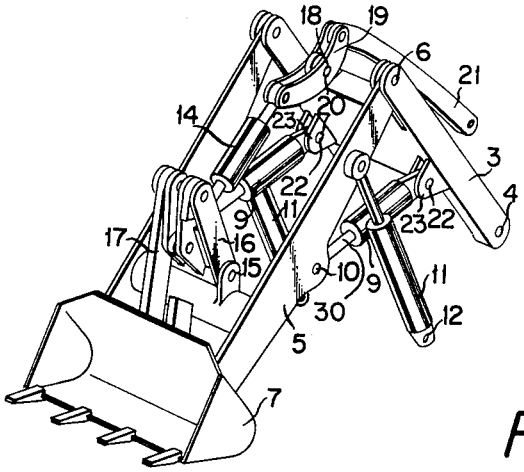
FIG. 7 is a perspective view of the main portion of the apparatus according to the modified embodiment of this invention.

FIG. 7 is a perspective view illustrating a modified embodiment of this invention. In this embodiment, the reach cylinder 9 is connected by a pin 22 to a bracket 23 which is formed on the reach lever 3 at an approximately center position thereof. Because the reach cylinder 9 is connected to the reach lever 3 at such an approximately center position of the reach lever 3, it is possible to obtain an increased horizontal moving distance of the bucket 7.

Now the operation of the apparatuses proposed herein will be explained.

Upon extending the reach cylinder 9, the reach lever 3 and lift cylinder 11 rotate around the pins 4 and 12, respectively, so that the lift arm 5 is advanced to thereby horizontally advance the bucket 7 in the linear direction. During this movement, the bucket 7 is always maintained in an unvaried position due to the action of rock lever 19 and rod 21.

When the lift cylinder 11 is extended, the lift arm 5 is swung up around the pivoting point 4 for the reach lever 3 and reach cylinder 9, and consequently the bucket 7 is swung up. At this time the bucket 7, prevented by the action of rock link 19 and rod 21 from being rotated rearwardly, swings up maintaining an unvaried constant position.

Even in the unreach position where the reach cylinder 9 is contracted to the full extent, the bucket 7 can be tilted back by contracting the tilt cylinder 14.

Figure 8:
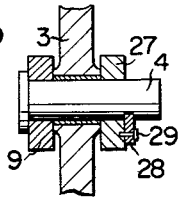
FIG. 8 is an enlarged sectional view illustrating the portion adapted for attaching the reach cylinder to the reach lever.

Referring to FIG. 8, the base end of reach cylinder 9 is pivoted at the pin 4, or the pivoting point of the reach lever 3 to the tractor body 2. A collar 27 is mounted around the pin 4 in such a manner that it is free from dropping off from the pin 4 by use of a retaining means 28 attached to the pin 4. Said retaining means 28 is attached to the collar 27 by means of a bolt 29.

Figure 9:
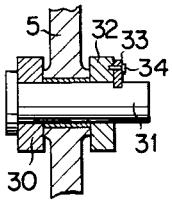
FIG. 9 is an enlarged sectional view illustrating the portion for attaching the reach cylinder to the lift arm.

Referring to FIG. 9, the rod 30 of cylinder 9 is pivoted to the lift arm 5 by use of the pin 10 to which a collar 32 is mounted. The collar 32 is prevented from being dropped off by means of a retaining member 33 mounted on the pin 31. Said retaining member 33 is attached to the collar 32 by a bolt 34.

Figure 10:
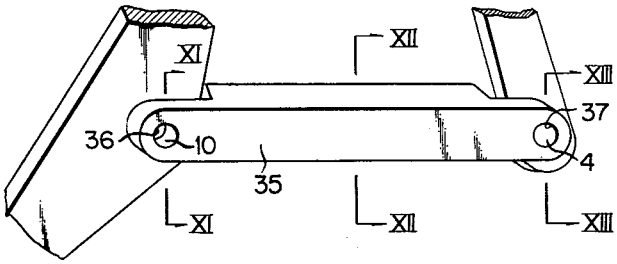
FIG. 10 is a view for explaining the position wherein a link is connected between the reach lever and lift arm.
Figure 11:
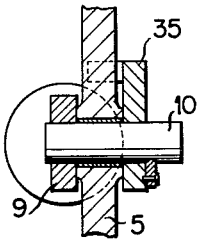
FIG. 11 is a sectional view taken along line XI—XI of FIG. 10.
Figure 12:
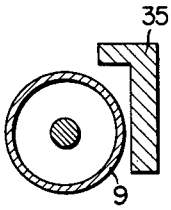
FIG. 12 is a sectional view taken along line XII—XII of FIG. 10.
Figure 13:
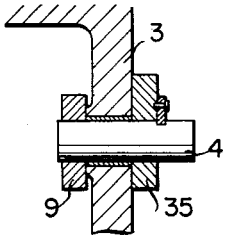
FIG. 13 is a sectional view taken along line XIII—XIII of FIG. 10.

Referring to FIG. 10, indicated at 35 is a link having an L-shaped configuration in section. The opposite ends of the link 35 are flattened and formed with pin holes 36 and 37, respectively. The operation length of this link 35 is selected to be identical with the minimum operation length of the reach cylinder 9. In case when the bucket 7 is to be moved along the ground surface through the displacement of tractor body, collars 27 and 32 are disengaged from pins 4 and 31, respectively, a link 35 is attached to pins 4 and 31 and the lift arm 5 is fixedly connected to the tractor body by means of the link 35. In this case, after mounting the link 35 around pins 4 and 10, retaining means 28 and 33 are attached on pins 4 and 41 and these retaining means 28 and 32 are secured to the link 35 by means of bolts 29 and 34, respectively (see FIGS. 11 to 13).

According to this invention, with the above-described construction, the bucket 7 can be moved forward and backward in a horizontal plane only through extending and contracting the reach cylinder 9 and, in addition, the bucket 7 can be flung up and down only through contracting and extending the lift cylinder 11. Furthermore, it is also possible to tilt back the bucket 7 only by means of a tilt cylinder 14 irrespective of the lift cylinder 11 being in an extended or contracted position.

Accordingly, this invention makes it possible to linearly move the bucket 7 forwardly and backwardly in a horizontal plane and to provide an apparatus having a reduced number of junctions and hence an increased rigidity. In addition, since the bucket 7 can be tilted back even in its unreach position, the apparatus increases the versatility of the loader because it allows the loader, in its unreach position, to effect operations similar to general dozershovels such as impact digging, tiltback and swinging up-and-down movements of the bucket 7.

Furthermore, the apparatus of this invention allows the shovel to be changed from reach type to rigid type only by attaching the link 35 to pins 4 and 10. It does not require to replace any assembly for changing the shovel from reach type to rigid type and vice versa.

What is claimed is:

1. An apparatus for controlling bucket in tractor mounted loader, comprising:

a. a body of the tractor;

b. a reach lever pivotally connected at its one end to said body;

c. a lift arm pivotally connected at its one end to the other end of said reach lever;

d. a bucket pivotally connected at its lever end to the other end of said lift arm;

e. a first cylinder means for reach operation of said bucket pivotally connected between said reach lever and a position approximately at the midpoint of said lift arm;

f. a second cylinder means for lift and down operation of said bucket pivotally connected between said body and a point between said one end and said approximate midpoint of said lift arm in such a manner that said second cylinder means form a deformable quadrilateral type linkage in combination of said body, said reach lever and said lift arm; and g. a third cylinder means for tilt operation of said bucket pivotally connected at its one end to an upper end of said bucket through a tilt rod and tilt lever which are pivotally connected to each other at their respective one end and are pivotally connected at the other end of said tilt rod to the upper end of said bucket and at the other end of said tilt lever to said lift arm respectively, said third cylinder means being pivotally connected at one end thereof to said tilt lever and at the other end thereof to said body of the tractor by the interposition of a rock link and a rod which are pivotally connected at their respective one end to each other and are pivotally connected at the other end of said rock link to said body and at the other end of said rod to said the other end of said third cylinder means, respectively, whereby an approximately horizontal reach operation is brought to said bucket by actuating only said first cylinder means to excavate in horizontal a relatively soft ground.

2. An apparatus as set forth in claim 1, further comprising a link detachably provided between said one end of said reach lever and said midpoint of said lift arm for fixedly connecting said lift arm to said body of the tractor so as to use said bucket as a rigid type.

* * * * *